US006227025B1

(12) United States Patent
Kutsuwada et al.

(10) Patent No.: US 6,227,025 B1
(45) Date of Patent: May 8, 2001

(54) ROLLING METHOD USING ROLLING GUIDE

(75) Inventors: Tatsuya Kutsuwada; Atsumu Nakamura; Haruotsu Ikeda, all of Hokkaido (JP)

(73) Assignee: Kotobuki Sangyo Kabushiki Kaisha, Sapporo (JP)

( * ) Notice: Subject to any disclaimer, the term of this patent is extended or adjusted under 35 U.S.C. 154(b) by 0 days.

(21) Appl. No.: 09/475,071

(22) Filed: Dec. 30, 1999

(30) Foreign Application Priority Data

Mar. 11, 1999 (JP) ..... 11-064677
Nov. 30, 1999 (JP) ..... 11-340063

(51) Int. Cl.[7] ..... B21B 39/20
(52) U.S. Cl. ..... 72/250
(58) Field of Search ..... 72/250, 251, 240

(56) References Cited

U.S. PATENT DOCUMENTS 3,765,214 * 10/1973 Boehmer ..... 72/250
4,039,107 * 8/1977 Boley ..... 72/250
4,073,173 * 2/1978 Marshall et al. ..... 72/250
4,123,927 * 11/1978 Brauer ..... 72/16
4,215,558 * 8/1980 Shiguma et al. ..... 72/240
4,400,963 * 8/1983 Epps ..... 72/250
4,470,285 * 9/1984 Cattaneo et al. ..... 72/251
4,680,953 * 7/1987 Fabris ..... 72/250
4,790,164 12/1988 Rothe ..... 72/250

FOREIGN PATENT DOCUMENTS 7-275916 10/1995 (JP) .
10-180337 7/1998 (JP) .

* cited by examiner

*Primary Examiner*—Rodney A. Butler
(74) *Attorney, Agent, or Firm*—Kanesaka & Takeuchi

(57) ABSTRACT

In a rolling method of rolling a material by front-stage rolling mill, a post-stage rolling mill and guiding rollers interposed therebetween. At first, a gap between the guiding rollers is set to a standard outer size of a standard material to be rolled by front-stage rolling rollers, and a standard embracing force formed by the guiding rollers at the gap is measured when the standard material passes therethrough. Then, a machine is operated, and a post outer size of a rolled material rolled by post-stage rolling rollers is measured. The post outer size of the rolled material is compared with a desired outer size of the rolled material. In case the post outer size of the material is smaller or greater than the desired outer size of the material, an embracing force of the guiding rollers during a rolling is compared with the standard embracing force. Then, the rollers are adjusted so that the post outer size of the material becomes the desired outer size.

6 Claims, 8 Drawing Sheets

ROLLING METHOD USING ROLLING GUIDE

BACKGROUND OF THE INVENTION

1. Field of the Invention

This invention relates to a method for rolling a material while guiding the whole of the rolled material from its leading end to its tail end to a caliber of rolling rolls by use of a roller guide disposed in a train of rolling mills for continuously rolling the material into section steel, bar steel, wire rod or the like.

2. Description of the Prior Art

There have been so far proposed rolling methods for increasing the accuracy of the outside size of a rolled material by providing a roller guide with a sensor or the like, as described hereinafter.

The rolling method using a roller entry guide disclosed in U.S. Pat. No. 4,790,164 adopts measuring means such as a pressure sensor to measure the stress of guide rollers suffered from the rolled material. In the conventional rolling method, the force of the rolled material exerted to the guide rollers is maintained constant on the basis of the results obtained from the measurement in order to compensate wear on the guide rollers and the front-stage rolling roll, and the axis of the roller entry guide is exactly aligned with a pass line to achieve high accuracy of the outside size of the rolled material.

There is disposed a pass line adjusting method for entry guide in Japanese Patent Application Publication No. HEI 07-275916(A). In this conventional method, after guiding a rolled material to a rolling mill by use of a roller guide disposed at the entrance of the rolling mill, the outside size of the stock rolled by the rolling mill is measured at the exit of the rolling mill to detect the dislocation of the roller guide relative to the pass line from the measured results, so that the axis of the roller entry guide is exactly aligned with a pass line to achieve the accuracy of the outside size of the rolled material.

The former rolling method described above makes it possible to ascertain whether the rolled material embraced by the guide rollers becomes thicker or thinner compared with a material having a standard outside size on the basis of values detected from sensors disposed on either side of the guide rollers for detecting the force of the rolled material exerted on the guide rollers. However, this conventional method involves a problem to be solved such that the gap between the guide rollers and embracing force of the guide rollers cannot be changed with a material to be rolled during a rolling process. Consequently, this conventional method entails such a disadvantage that the gap between the guide rollers cannot be finely adjusted even when it is slightly wide or narrow and required to be adjusted.

The latter rolling method enables the alignment of the roller guide with the pass line to be effected so as to bring the shape of the rolled material close to the desired shape while measuring the outside size of the roller material. This conventional method should be improved so as to produce a rolled material with high dimensional accuracy by regulating the gap between the guide rollers and embracing force of the guide rollers.

OBJECT OF THE INVENTION

An object of the present invention is to provide a rolling method capable of producing a rolled material having high dimensional accuracy.

Another object of the present invention is to provide a rolling method using a roller guide for effectively guiding a material rolled by rolling rolls in a front-stage rolling mill to a post-stage rolling mill.

Still another object of the present invention is to provide a rolling method adopting a roller guide incorporating guide rollers capable of changing a gap by a driving cylinder.

SUMMARY OF THE INVENTION

To attain the object described above according to the present invention, there is provided a rolling method using a roller guide having guide rollers for guiding a rolled materials rolled by rolling rolls of a front-stage rolling mill to a post-stage rolling mill. A gap between the guide rollers are controlled by a driving cylinder so as to satisfy Rp1=Rp, wherein Rp is a standard, under a condition [1] mentioned below, and allow Pf to approach S to obtain a finally objective value Pf=S when performing a rolling process for a rolled material under a condition [2] mentioned below:

Condition [1]: S>Pf and Rp1>Rp

Condition [2]: Satisfying either or both of the following corrective rolling conditions (1) and (2) to change the roll gap between the guide rollers:

Corrective Rolling Condition (1): G11<G1

(decrease a roll gap between front-stage rolling rolls to change from G1 to G11), and Corrective Rolling Condition (2): G21>G2

(increase a roll gap between post-stage rolling rolls to change from G2 to G21), wherein, Rg is a gap between the guide rollers, which is determined to a standard outside size of a material to be rolled by the front-stage rolling rolls, Rg1 is a gap between the guide rollers during guiding the rolled material in rolling, Rp is a standard embracing force produced by the guide rollers in permitting the rolled material having a standard outside size to pass through between the guide rollers with a gap defined for the gap Rg, Rp1 is an embracing force produced by the guide rollers in guiding the rolled material by the guide rollers with the gap Rg1 in the rolling process, G1 is a current roll gap between rolling rolls in a front-stage rolling mill, G11 is a roll gap changed from the roll gap G1, G2 is a current roll gap between the rolling rolls in a post-stage rolling mill, G21 is a roll gap changed from the roll gap G2, Pf is an outside size of the material rolled by the post-stage rolling mill, which is measured by use of measuring means such as a profile meter disposed on the downstream side of the post-stage rolling mill, and S is an outside size of a desired rolled material.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

The method for rolling a material using a roller guide 1 shown in FIG. 1 through FIG. 3, while controlling the gap as a standard between guide rollers 2 and the embracing force produced by the guide rollers, will be described hereinafter.

First, the roller guide 1 applied for the rolling method of the invention will be described.

The roller guide 1 is located between, for example, the front-stage rolling mill and the post-stage rolling mill of a train of rolling mills on the entrance side of the post-stage rolling mill.

Figure 6:
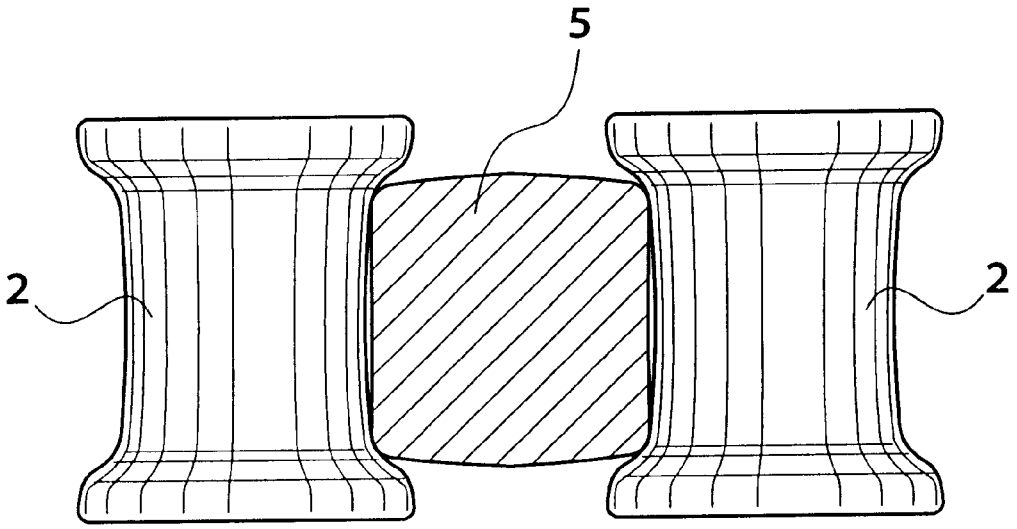
FIG. 6 is a front view showing the guide rollers in the roller guide of the invention.

As shown in FIG. 1 through FIG. 4, the roller guide 1 is provided with a pair of guide rollers 2. The guide rollers 2 are each supported in a free rotatable state by an eccentric axial member 4*a* of a support shaft 4 rotatably supported by a guide box 3. The guide rollers 2 serve to guide a material 5 to be rolled (FIG. 6). A hydraulic cylinder 6 which is a driving cylinder is secured on the guide box 3.

The hydraulic cylinder 6 is provided for regulating a gap between the guide rollers 2 and a force for embracing the rolled material 5 which is produced by the guide rollers by remote control.

Figure 5:
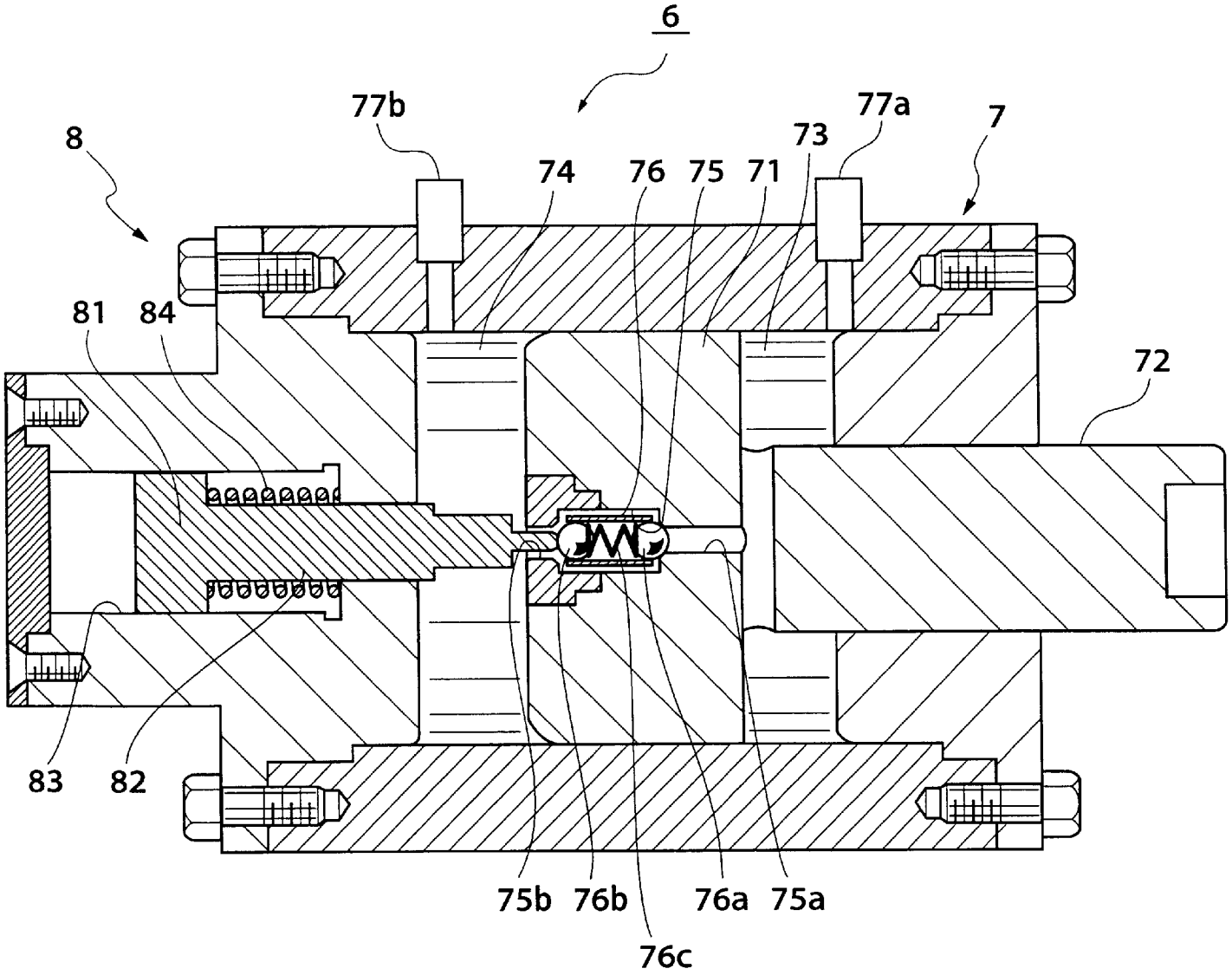
FIG. 5 is an enlarged view showing a hydraulic cylinder in the roller guide of the invention.

Although the hydraulic cylinder 6 in the embodiment shown in FIG. 5 is substantially the same as the driving cylinder described in Japanese Patent Application Publication No. HEI 10-180337(A), it is by no means limited thereto. The hydraulic cylinder 6 as illustrated comprises an embracing-force regulator 7 for regulating the embracing force produced by the guide rollers, which is shown on the right side of FIG. 5, and a gap regulator 8 for regulating the gap between the guide rollers, which is shown on the left side of the same.

The embracing-force regulator 7 is provided with a piston 71 and a piston rod 72. The piston rod 72 of the hydraulic cylinder 6 is provided at its one end with a rack gear 9 (FIG. 2). The rack gear 9 has both end parts engaged with pinions 4*b* mounted respectively on the top (upper end portion) of each supporting shaft 4. The embracing-force regulator 7 has a pull-side chamber 73 on the right side of the piston 71 and a push-side chamber 74 on the left side of the piston 71. In the piston 71, there are formed passages 75*a* and 75*b* for connecting a regulating chamber 75 to chambers 73 and 74 located one on either side of the regulating chamber 75. A retainer 76 accommodating two balls 76*a* and 76*b* and a spring 76*c* positioned between the balls is disposed inside the regulating chamber 75. Reference numeral 77*a* denotes a pull-side working-oil port, and 77*b* denotes a push-side working-oil port.

The gap regulator 8 incorporates a piston 81 and a piston rod 82. Through the push-side chamber 74, the piston rod 82 is allowed to collide at its leading end with the ball 76*b* located on the left side of the regulating chamber 75. A pressure chamber 83 has a working-oil port (not shown) through which working oil is fed thereinto to thrust the piston rod 82 against the spring 84. Thus, by controlling the pressure of the working oil, the piston rod 82 can be held at a position of equilibrium between the pressure of the applied working oil and the energizing force of the spring 84.

Figure 8:
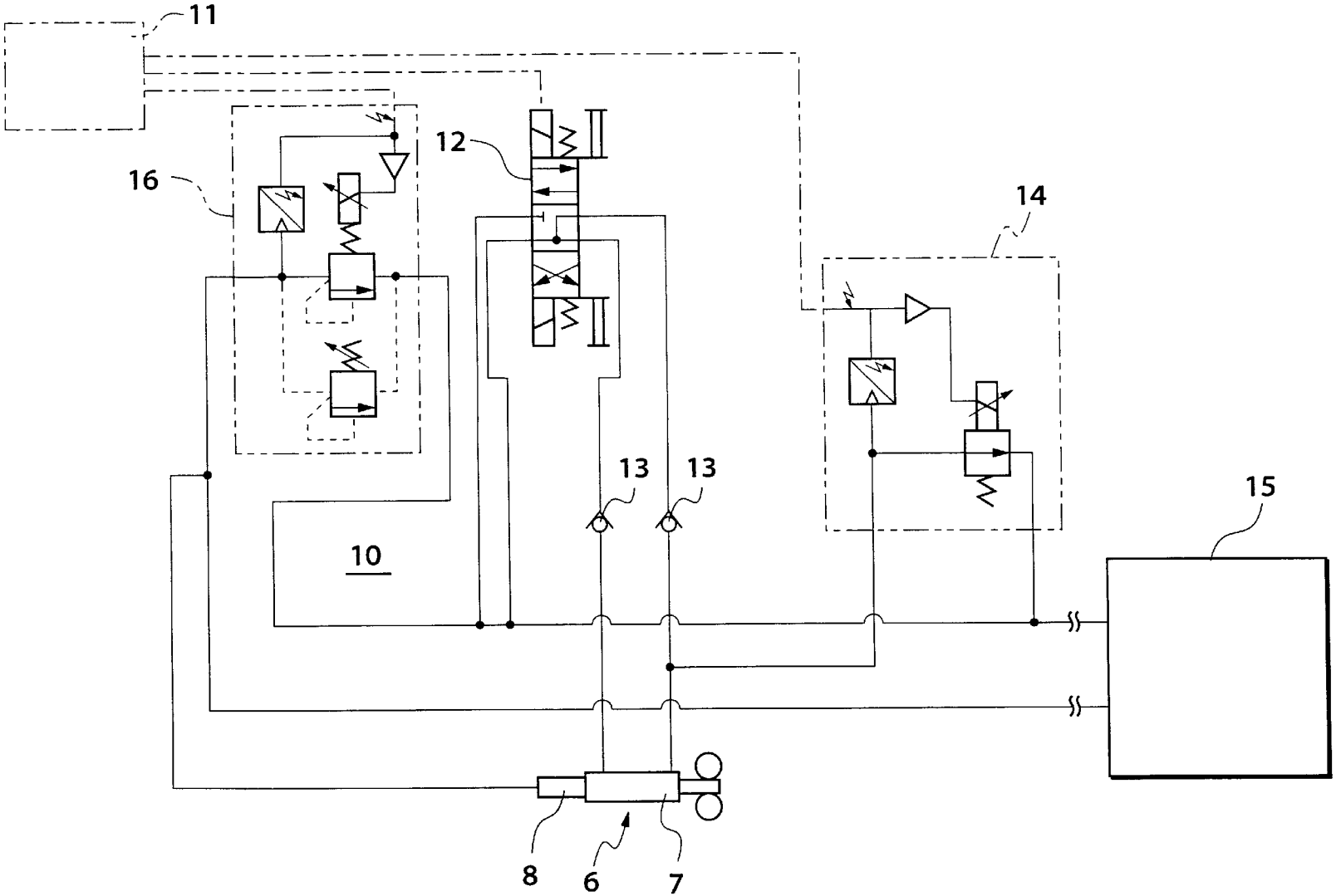
FIG. 8 is an explanatory diagram showing a hydraulic control circuitry of the invention.

The roller guide 1 is controlled by a hydraulic control circuitry 10 and a control managing unit 11 as shown in FIG. 8. In the hydraulic control circuitry 10, an electromagnetic valve 12 is connected to the embracing-force regulator 7 for the guide rollers in the hydraulic cylinder 6 through a pilot check valve 13 and electrically to the control managing unit 11. A proportional relief valve 14 with an electromagnetic valve has one port connected to a hydraulic unit 15 and the embracing-force regulator 7 for the guide rollers in the hydraulic cylinder 6 and another port connected to the control managing unit 11 to form a circuitry for remote controlling the embracing force of the guide rollers 2.

A proportionally-electromagnetic pilot relief valve 16 has one port connected to the gap regulator 8 for the guide rollers in the hydraulic cylinder 6 and another port connected to the control managing unit 11 to form a circuitry for remote controlling the gap between the guide rollers 2. The control managing unit 11 enables operations of inputting an embracing force value and a value representing a distance between the centers of the rollers. The control managing unit 11 has a function of displaying the embracing force value and the distance value on a monitor.

Figure 2:
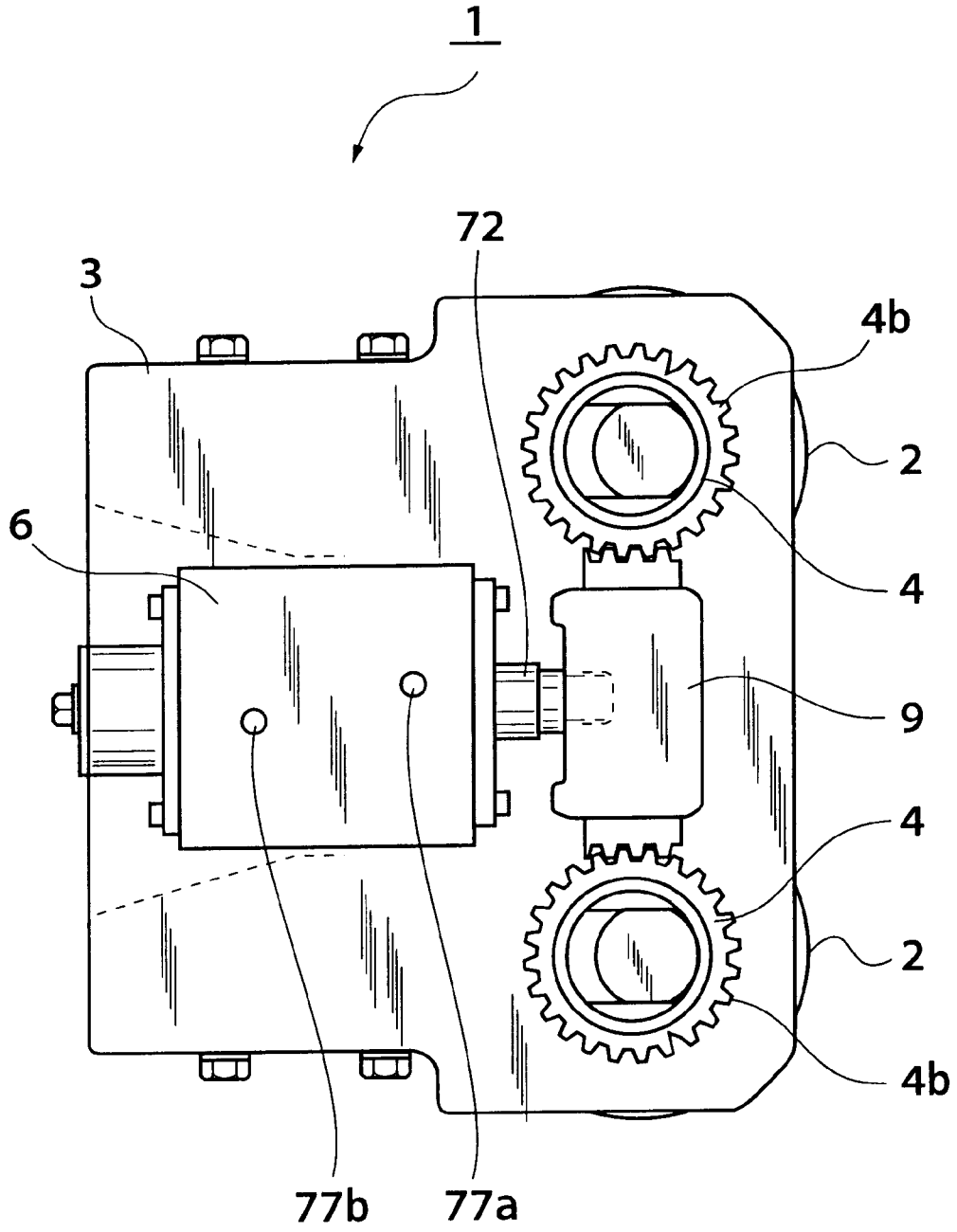
FIG. 2 is a plan view of the roller guide of FIG. 1.

By moving the piston rod 72 rightward in FIG. 2 and FIG. 5 by applying pressure oil to the gap regulator 8 for the guide rollers in the hydraulic cylinder 6 by remote control of the control managing unit 11, the distance between the guide rollers 2 is increased. On the contrary, by moving the piston rod 72 leftward in FIG. 2, the distance between the guide rollers 2 is decreased.

Figure 7:
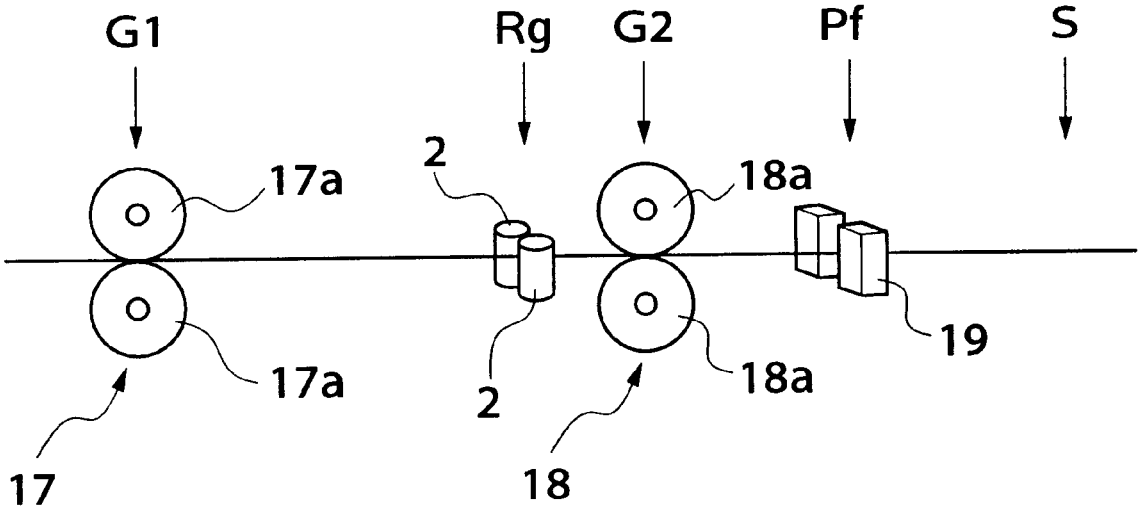
FIG. 7 is an explanatory diagram showing the relationship among rolling mill train, rolled material, guide rollers and profile meter.

As shown in FIG. 7, the roller guide 1 is located between the front-stage rolling mill with rolling rolls 17 (on the left side in the drawing) and the post-stage rolling mill (finishing rolling mill in this embodiment) with rolling rolls 18. By the guide rollers 2 of the roller guide 1, the material 5 rolled by the rolling rolls 17 of the front-stage rolling mill is guided to between the rolling rolls 18 of the post-stage rolling mill. On the downstream side (right side in FIG. 7) of the post-stage rolling mill, there is disposed a profile meter 19 for measuring the outside size of the rolled material obtained through between the post-stage rolling rolls 18.

Figure 1:
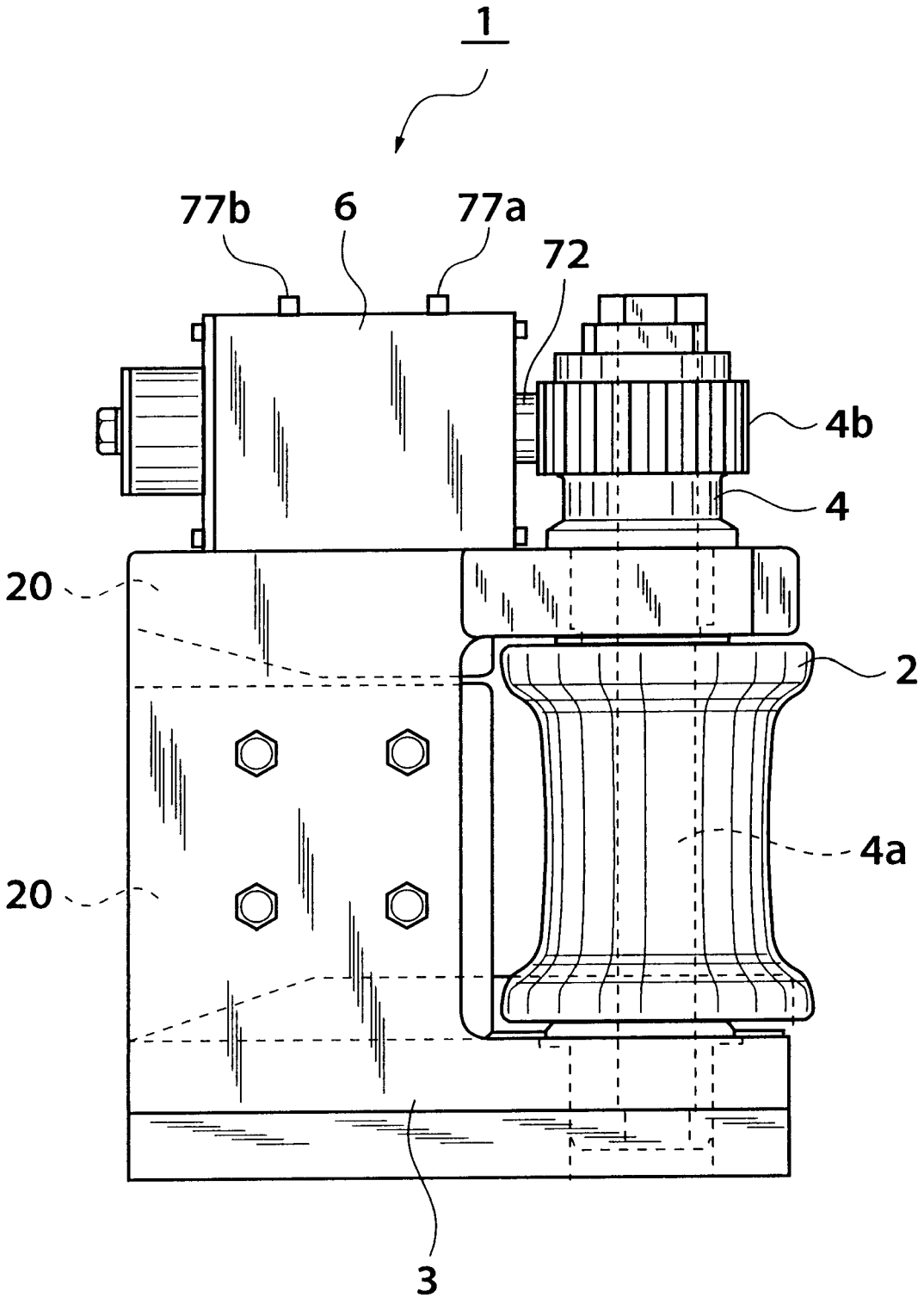
FIG. 1 is a front view showing a roller guide used for a rolling method according to this invention.
Figure 3:
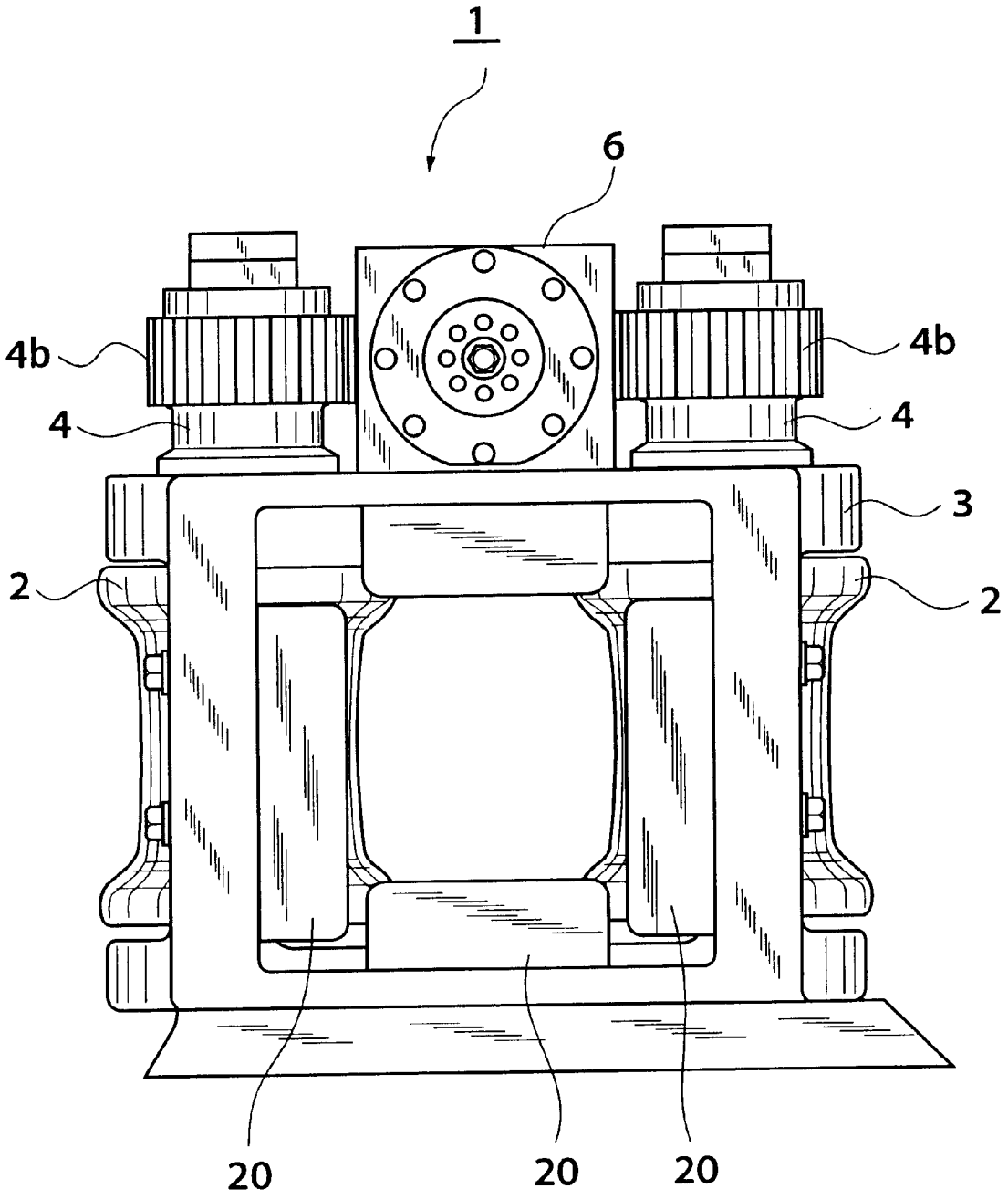
FIG. 3 is a side view of the roller guide of FIG. 1.
Figure 4:
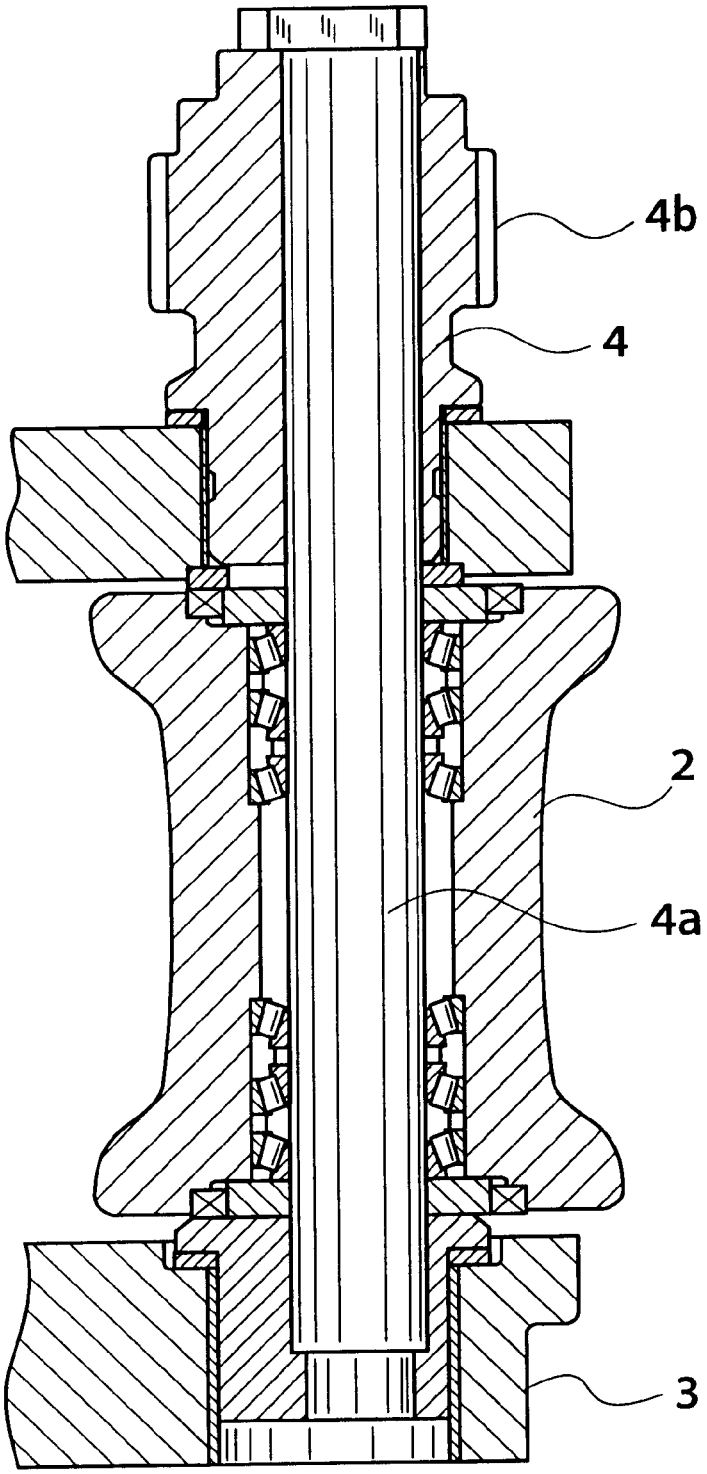
FIG. 4 is an enlarged sectional view showing the state in which guide rollers of the roller guide of the invention are installed.

Entry triggers 20 are respectively arranged on the upper, lower, right and left sides of the guide box 3 in a substantially cylindrical configuration as shown in FIG. 1 through FIG. 3.

Next, a method for rolling the rolled material by use of the roller guide 1 will be described.

<Preparatory Process for Rolling Operation>

The rolled material rolled by the rolling rolls 17 of the front-stage rolling mill is further rolled by the rolling rolls 18 of the post-stage rolling mill after passing through between the guide rollers 2 of the roller guide 1. Hence, the gap between the guide rollers 2 is previously adjusted to a desired outside size (standard outside dimensions) for the rolled material rolled by the front-stage rolling rolls 17. Simultaneously, the stress with which the rolled material reacts on the guide rollers 2, namely, a standard embracing force of the guide rollers 2, is previously measured.

Thus, the gap Rg between the guide rollers and the embracing force Rp of the guide rollers are determined in advance as standard values in accordance with the standard outside size of the rolled material rolled by the front-stage rolling rolls 17. Rg represents the gap between the guide rollers which is set to the standard outside size of the rolled material rolled by the front-stage rolling rolls 17. Rp represents the standard embracing force imparted to the guide rollers when the rolled material having the standard outside size passes through between the guide rollers 2 spaced at the gap Rg.

The gap between the guide rollers 2 is adjusted to the value Rg consistent with the standard outside size of the rolled material in the following manner.

The gap between the guide rollers 2 is made slightly narrower than the rolled material rolled by the front-stage rolling rolls 17 spaced at a current roll gap G1 (FIG. 7) of the front-stage rolling rolls 17. Then, a gauge bar having the same size as the rolled material is inserted into between the guide rollers 2 thus adjusted, so as to involve the relation between Rp and Rg illustrated in FIG. 9A.

The piston rod 72 of the hydraulic cylinder 6 linked to the rack gear 9 is moved by a predetermined distance by supplying the working oil into the pressure chamber 83 (FIG. 5) in the gap regulator 8 of the hydraulic cylinder 6 shown in FIG. 8 while controlling the pressure of the working oil. The pressure of the working oil is controlled by the proportionally-electromagnetic pilot relief valve 16. Since the rack gear 9 is engaged with the pinion 4*b*, the support shaft 4 rotates in proportion to the amount of movement of the piston rod 72. The gap of the guide rollers 2 is determined in accordance with the angle at which the support shaft rotates.

<Rolling Process>

In FIG. 7, the roll gap between the front-stage rolling rolls 17 is expressed by G1, the current value of the roll gap between the rolling rolls 18 in the post-stage rolling mill is expressed by G2, the outside size of the rolled material, measured by the profile meter 19 disposed on the downstream side of the finishing rolling mill, is expressed by Pf, and the desired outside size of the rolled material is expressed by S.

When the rolling process starts, the rolled material rolled by the rolling rolls 17 of the front-stage rolling mill is inserted into between the guide rollers 2 spaced at the regulated gap. Consequently, the gap of the guide rollers 2, which is determined to be slightly narrower than the outside size of the rolled material at the outset, becomes large into Rg1, and then, the pressure of the oil in the circuitry incorporating the proportional relief valve 14 with the electromagnetic valve shown in FIG. 8 is increased to vary the embracing force of the guide rollers 2.

Figure 9A:
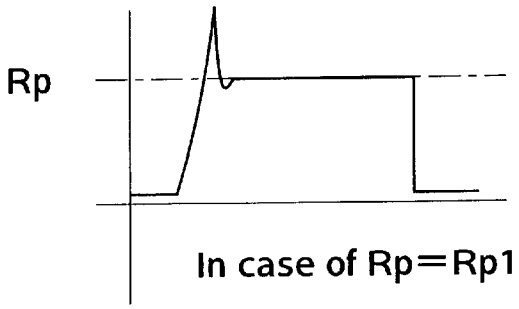
FIGS. 9A through 9D are graphs showing the relation between an embracing force of the guide rollers exerted on the rolled material in a rolling operation and a standard embracing force for the rolled material.

At this time, if the outside size of the rolled material is equal to the gauge bar, the rolling state can be deemed normal as shown in FIG. 9A, so that the embracing force of the guide rollers in the normal state is memorized as the standard embracing force Rp. At this time, there are defined Rg=Rg1, and Rp=Rp1.

In the graphs of FIG. 9A and FIGS. 9B to 9D as touched upon later, the oxdinate of the graph represents an embracing force of the guide rollers, and the abscissa represents elapsed time, respectively.

The values of the gap and embracing force of the guide rollers 2 during the operation of guiding the rolled material are displayed on the monitor of the control managing unit 11.

The maximum relief pressure of the proportional relief valve 14 with the electromagnetic valve, i.e. the maximum embracing force of the guide rollers 2, is predetermined so as not to damage the roller guide 1.

Accomplishment of (measured value Pf)=(desired outside size S) using Rp (standard embracing force) as a standard and G1, G11, G2 and G21 as parameters is a final objective to perform the rolling operation according to the present invention.

To achieve this objective, the present invention adopts a rolling method fulfilling the following conditions [1] and [2].

[1] S>Pf

Namely, when the outside size Pf of the rolled material rolled by the post-stage rolling rolls 18 is smaller than the desired outside size S of the rolled material:

① Rp1>Rp [I]

② Rp1<Rp [II]

[2] S<Pf

Namely, when the outside size Pf of the rolled material rolled by the post-stage rolling rolls 18 is larger than the desired outside size S of the rolled material:

③ Rp1>Rp [III]

④ Rp1<Rp [IV]

The rolling method consisting of the processes [I] to [IV] will be described hereinafter.

①: S>Pf, Rp1>Rp [I] . . . [1]

Figure 9B:
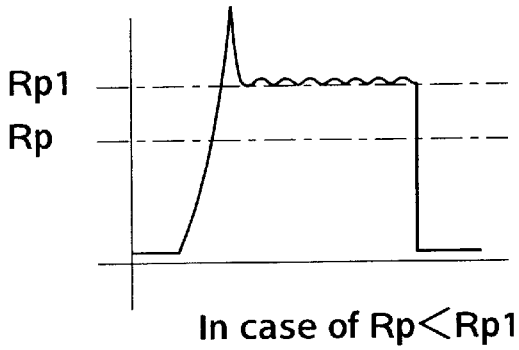

In the following case as shown in FIG. 9B:

Rp1 (Embracing force in rolling)>Rp (Standard embracing force), the roll gap G1 of the front-stage rolling rolls 17 and the roll gap G2 of the post-stage rolling rolls 18 are regulated so as to satisfy Rp1=Rp wherein Rp is a standard. Under this condition, the rolling operation is carried out in accordance with either or both of the following corrective rolling conditions (1) and (2) to change the roll gap. The rolling is performed so as to bring the measured value Pf close to the desired value S, consequently to fulfill (measured value Pf)=(desired value S).

Rolling Condition (1): G11<G1

(decrease a roll gap between front-stage rolling rolls to change from G1 to G11)

Rolling Condition (2): G21>G2

(increase a roll gap between post-stage rolling rolls to change from G2 to G21)

The method for rolling under the rolling conditions noted above will be described in detail.

The rolling conditions fulfilled in the case of S>Pf and Rp1>Rp are as follows:

(i) Condition under which the outside size of the rolled material rolled by the front-stage rolling rolls 17 having the roll gap G1 and passing through between the guide rollers spaced at the gap Rg is larger than the desired values.

Under those conditions, the gap between the guide rollers 2 becomes Rg<Rg1, and the embracing force brought about by the rolled material becomes Rp1>Rp.

(ii) Condition under which the outside size of 'the rolled material rolled by the post-stage rolling rolls 18 having the roll gap G2 is smaller than the desired value S.

To cope with the aforesaid conditions (i) and (ii), it is necessary to satisfy both the following corrective rolling conditions (1) and (2) to change the roll gap. Moreover, the condition (i) requires the rolling condition (1), and the condition (ii) requires the rolling condition (2).

Corrective rolling condition (1): G11<G1

The roll gap between the front-stage rolling rolls 17 is decreased. (That is, the roll gap G1 is changed to the roll gap G11 narrower than G1.)

Corrective rolling Condition (2): G21>G2

The roll gap G2 between the post-stage rolling rolls 18 is increased. (That is, the roll gap G2 is changed to the roll gap G21 wider than G2.)

To cope with the condition (i), the roll gap G1 is changed to decrease the outside size of the rolled material rolled by the front-stage rolling rolls 17, thus effecting Rp1=Rp and Rg=Rg1. Consequently, the outside size of the rolled material at the entrance of the post-stage finishing rolling mill becomes equal to the desired value S, so that the outside size of the rolled material led to the entrance of the finishing rolling mill can be regulated.

To cope with the condition (ii), the roll gap G2 is changed to bring the measured value Pf close to the desired value S. Thereupon, the rolling is carried out so as to obtain the final objective relation, i.e. (measured value Pf)=(desired value S). As a result, the rolled material can be rolled with a high accuracy of dimensions.

Figure 9C:
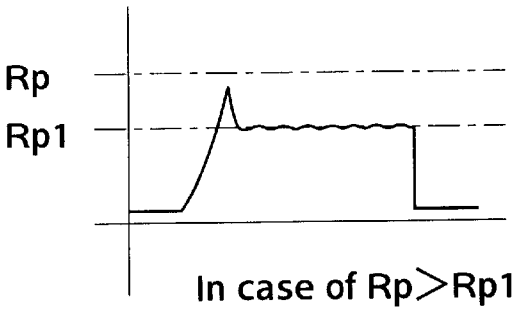
Figure 9D:
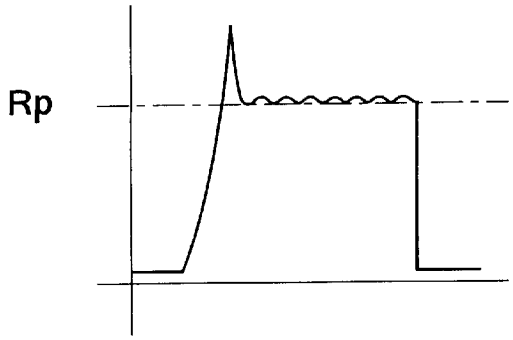

In the rolling process to fulfill the final objective relation Pf=S, when the embracing force Rp of the guide rollers is substantially equal to Rp1 as shown in FIG. 9D, the rolling method of the invention is applied discriminating between the following rolling conditions (a) and (b).

(a) Slightly narrow gap Rg1 between the guide rollers:

In a case that the gap between the guide rollers 2 is slightly narrower than the outside size of the rolled material rolled by the front-stage rolling rolls 17, the rolled material is subjected to a pinching pressure and difficult to smoothly pass through between the guide rollers. Consequently, the embracing force of the guide rollers fluctuates within a minute range. Accordingly, when the outside size of the rolled material measured by the profile meter 19 is slightly large, the rolled material can be rolled with a high accuracy of dimensions by making the gap Rg1 between the guide rollers wide to some extent.

(b) Slightly wide gap Rg1 between the guide rollers:

In a case that the gap between the guide rollers 2 is slightly wider than the outside size of the rolled material rolled by the front-stage rolling rolls 17, the rolled material is possibly laid on its side or vibrates due to a gap between itself and the guide rollers, consequently causing the embracing force of the guide rollers to fluctuate within a minute range. Accordingly, when the outside size of the rolled material measured by the profile meter 19 is slightly small, the rolled material can be rolled with a high accuracy of dimensions by making the gap Rg1 between the guide rollers narrow to some extent.

②: S>Pf, Rp1<Rp [II] . . . [1]

In this case, the following rolling method is applied.

As seen from FIG. 9C, the resultant embracing force Rp by the hydraulic cylinder 6 is related to Rp1 by the following equation.

Rp1 (Embracing force in rolling)<Rp (Standard Embracing force)

Thus, the roll gaps G1 and G2 are regulated to satisfy Rp1=Rp wherein Rp is a standard, so that the outside size of the rolled material rolled by the post-stage rolls having the roll gap G2 approaches Pf=S.

From S>Pf and Rp1<Rp, the rolling condition can be considered as follows.

(i) Condition under which the outside size Pf of the rolled material rolled by the front-stage rolling rolls 17 having the roll gap G1 is smaller than the desired value S:

The gap between the guide rollers proves to be Rg>Rg1, and the embracing force of the rolled material proves to be Rp1<Rp.

(ii) Condition under which the outside size Pf of the rolled material rolled by the post-stage rolling rolls 18 having the roll gap G2 is smaller than the desired value S:

Under the condition (i), the roll gap G1 between the front-stage rolling rolls 17 is made wide so as to be G11>G1, and the outside size of the rolled material rolled by the front-stage rolling rolls is made large so as to be Rp1=Rp and Rg=Rg1. Consequently, the outside size of the rolled material at the entrance of the finishing rolling mill becomes equal to that of the desired rolled material, so that the outside size of the rolled material led to the entrance of the finishing rolling mill can be appropriately regulated using the standards of Rp and Rg.

Under the condition (ii), the roll gap G2 between the post-stage rolling rolls 18 is made wide so as to be G21>G2, so that the rolled material can be rolled with a high accuracy of dimensions by satisfying Pf=S.

To cope with the aforesaid conditions (i) and (ii), it is necessary to satisfy both the following corrective rolling conditions (1) and (2) to change the roll gap. Moreover, the condition (i) requires the rolling condition (1), and the condition (ii) requires the rolling condition (2).

Corrective rolling condition (1): G11>G1

The roll gap between the front-stage rolling rolls 17 is increased. (That is, the roll gap G1 is changed to the roll gap G11 wider than G1.)

Corrective rolling Condition (2): G21>G2

The roll gap G2 between the post-stage rolling rolls 18 is increased. (That is, the roll gap G2 is changed to the roll gap G21 wider than G2.)

When the embracing forces Rp and Rp1 of the guide rollers are approximately equal to each other as shown in FIG. 9D in the rolling process to fulfill the (finally objective measured value Pf)=(desired value S), the rolling method of the invention is applied by judging following rolling conditions (a) and (b). This rolling method enables an effective rolling operation for producing a rolled material having a high accuracy of dimensions.

(a) Slightly narrow gap Rg1 between the guide rollers (b) Slightly wide gap Rg1 between the guide rollers The rolling method under these conditions may be carried out in much the same way as the method effected under the aforementioned condition [I] of S>Pf and Rp1>Rp, and therefore, the description thereof is omitted below to avoid repetition.

③: S<Pf, Rp1>Rp [III] . . . [2]

In the following case as shown in FIG. 9B:

Rp1 (Embracing force in rolling)>Rp (Standard Embracing force), the roll gap G1 of the front-stage rolling rolls 17 and the roll gap G2 of the post-stage rolling rolls 18 are regulated so as to satisfy Rp1=Rp wherein Rp is a standard. Under this condition, the rolling operation is carried out in accordance with either or both of the following corrective rolling conditions (1) and (2) to change the roll gap. The rolling is performed so as to bring the measured value Pf close to the desired value S, consequently to fulfill (measured value Pf)=(desired value S).

Rolling Condition (1): G11<G1

(decrease a roll gap between front-stage rolling rolls to change from G1 to G11)

Rolling Condition (2): G21<G2

(decrease a roll gap between post-stage rolling rolls to change from G2 to G21)

④: S<Pf, Rp1<Rp [IV] . . . [2]

In the following case as shown in FIG. 9C:

Rp1 (Embracing force in rolling)<Rp (Standard Embracing force), the roll gap G1 of the front-stage rolling rolls 17 and the roll gap G2 of the post-stage rolling rolls 18 are regulated so as to satisfy Rp1=Rp wherein Rp is a standard. Under this condition, the rolling operation is carried out in accordance with either or both of the following corrective rolling conditions (1) and (2) to change the roll gap. The rolling is performed so as to bring the measured value Pf close to the desired value S, consequently to fulfill (measured value Pf)=(desired value S).

Rolling Condition (1): G11>G1

(increase a roll gap between front-stage rolling rolls to change from G1 to G11)

Rolling Condition (2): G21>G2

(decrease a roll gap between post-stage rolling rolls to change from G2 to G21)

In the rolling processes carried out under the foregoing conditions [III] and [IV], when the embracing force Rp of the guide rollers is substantially equal to Rp1 as shown in FIG. 9D, the rolling method of the invention is applied by judging the following rolling conditions (a) and (b). This rolling method enables an effective rolling operation for producing a rolled material having a high accuracy of dimensions.

(a) Slightly narrow gap Rgl between the guide rollers (b) Slightly wide gap Rgl between the guide rollers The rolling method under these conditions may be carried out in much the same way as the method effected under the aforementioned condition [I] of S>Pf and Rp1>Rp, and therefore, the description thereof is omitted below to avoid repetition.

In a case that the rolling method of the invention is first applied actually without using such rolling data as described above, the maximum embracing force of the guide rollers 2 is determined to be rather small at first by controlling the proportional relief valve 14 with the electromagnetic valve, and then, the embracing force is gradually increased to become finally the optimum value, so that the guide rollers 2 and bearings are prevented from being damaged even when a part of the rolled material, which is larger in size than a whole from the leading end to the tail end thereof, enters into between the guide rollers 2, and the rolled material is prevented from falling down.

For determining the standard embracing force Rp and gap Rg, it is preferred that the embracing forces Rp1 and Rg1 by which the proper resultant relation Pf=S is obtained are determined, as reference values based on the proper rolling operation actually effected, by observing the result displayed on the monitor, and used as the values Rp and Rg1 for the succeeding rolling operations.

A means for measuring the outside size of the rolled material rolled by the post-stage rolling mill is by no means limited only to the profile meter 19 used in the foregoing embodiment. For example, there may be used a second roller guide analogous to the roller guide 1 disposed between the front-stage rolling mill and the post-stage rolling mill. In this case, the second roller guide may be disposed on the downstream side of the post-stage rolling mill, so that the outside size of the rolled material can be measured using data of the embracing force of the guide rollers of the roller guide 1 on the basis of change of the gap between the guide rollers of the second roller guide.

Although the roller guide in the embodiment of the invention described above is used as an entrance roller guide, it may be used as an exit roller guide disposed at the exit of the rolling mill or an intermediate roller guide disposed between the rolling mills. Although the post-stage rolling mill in the embodiment of the invention is used as the finishing rolling mill, it can be applied to a reciprocating-type rolling mill for billet or the like, rolling mill of a rolling mill train for roughing, intermediate rolling and finishing, or a rolling mill of any other type.

The method for rolling the rolled material, in which the rolled material is exactly guided to the caliber of the rolling rolls by means of the roller guide disposed at the entrance of one rolling mill in the rolling mill train, was described above as one example. However, the method of the present invention may of course be applied to a reverse mill for effecting a reciprocating rolling operation. In this case, the roller guide is disposed at the entrance or exit of the reverse mill, so that the whole of the rolled material from its leading end to its tail end is exactly guided to achieve high accuracy of the outside size of the rolled material. Furthermore, the method of the invention can be applied to various rolling methods for shaping and rolling rolled materials such as skin pass rolling and sizing rolling methods.

As is apparent from the foregoing description, according to the rolling method of the present invention in which rolling is controlled in accordance with the gap between the rolling rolls so in conformity with the standard of the embracing force of the guide rollers, rolled materials having highly accurate outside size can be produced with ease even by an inexperienced worker without requiring highly skilled technique in a similar manner as processed by a skilled person.

As can be readily appreciated, it is possible to deviate from the above embodiments of the present invention and, as will be readily understood by those skilled in this art, the invention is capable of many modifications and improvements within the scope and spirit thereof. Accordingly, it will be understood that the invention is not to be limited by these specific embodiments, but only by the scope and spirit of the appended claims.

What is claimed is:

1. A rolling method of rolling a material from a front-stage rolling mill having front-stage rolling rollers to a post-stage rolling mill having post-stage rolling rollers through guiding rollers of a roller guide, comprising:

setting a gap between the guiding rollers to a standard outer size of a standard material to be rolled by the front-stage rolling rollers, and measuring a standard embracing force formed by the guiding rollers at the gap when the standard material passes therethrough, operating the front-stage rolling rollers, guiding rollers and post-stage rolling rollers to roll a material to be rolled, measuring a post outer size of the rolled material rolled by the post-stage rolling rollers, comparing the post outer size of the rolled material and a desired outer size of the rolled material, comparing an embracing force of the guiding rollers during a rolling with the standard embracing force in case the post outer size of the material is smaller than the desired outer size of the material, and adjusting the rollers so that the post outer size of the material becomes substantially equal to the desired outer size by taking one of steps:

(a) reducing a roll gap between the front-stage rolling rollers in case the embracing force during the rolling is greater than the standard embracing force, (b) reducing the roll gap between the front-stage rolling rollers and enlarging a roll gap between the post-stage rolling rollers in case the embracing force during the rolling is greater than the standard embracing force, (c) enlarging the roll gap between the front-stage rolling rollers in case the embracing force during the rolling is less than the standard embracing force, and (d) enlarging the roll gap between the front-stage rolling rollers and enlarging the roll gap between the post-stage rolling rollers in case the embracing force during the rolling is less than the standard embracing force.

2. A rolling method according to claim 1, wherein said roller guide is controlled by an oil pressure controlling circuit and a controlling section, and the gap between the guiding rollers and the embracing force by the guiding rollers are controlled by a cylinder.

3. A rolling method according to claim 1, wherein when the standard embracing force of the guiding rollers becomes substantially equal to the embracing force of the guiding rollers during the rolling, in case a roll gap between the guiding rollers during the rolling is slightly greater than an outer size of the material rolled by the front-stage rolling rollers and the post outer size of the material is slightly less than the desired outer size of the material, the roll gap between the guiding rollers is reduced.

4. A rolling method of rolling a material from a front-stage rolling mill having front-stage rolling rollers to a post-stage rolling mill having post-stage rolling rollers through guiding rollers of a roller guide, comprising:

setting a gap between the guiding rollers to a standard outer size of a standard material to be rolled by the front-stage rolling rollers, and measuring a standard embracing force formed by the guiding rollers at the gap when the standard material passes therethrough, operating the front-stage rolling rollers, guiding rollers and post-stage rolling rollers to roll a material to be rolled, measuring a post outer size of the rolled material rolled by the post-stage rolling rollers, comparing the post outer size of the rolled material and a desired outer size of the rolled material, comparing an embracing force of the guiding rollers during a rolling with the standard embracing force in case the post outer size of the material is greater than the desired outer size of the material, and adjusting the rollers so that the post outer size of the material becomes substantially equal to the desired outer size by taking one of steps:

(a) reducing a roll gap between the front-stage rolling rollers in case the embracing force during the rolling is greater than the standard embracing force, (b) reducing the roll gap between the front-stage rolling rollers and reducing a roll gap between the post-stage rolling rollers in case the embracing force during the rolling is greater than the standard embracing force, (c) enlarging the roll gap between the front-stage rolling rollers in case the embracing force during the rolling is less than the standard embracing force, and (d) enlarging the roll gap between the front-stage rolling rollers and reducing the roll gap between the post-stage rolling rollers in case the embracing force during the rolling is less than the standard embracing force.

5. A rolling method according to claim 4, wherein said roller guide is controlled by an oil pressure controlling circuit and a controlling section, and the gap between the guiding rollers and the embracing force by the guiding rollers are controlled by a cylinder.

6. A rolling method according to claim 4, wherein when the standard embracing force of the guiding rollers becomes substantially equal to the embracing force of the guiding rollers during the rolling, in case a roll gap between the guiding rollers during the rolling is slightly smaller than an outer size of the material rolled by the front-stage rolling rollers and the post outer size of the material is slightly greater than the desired outer size of the material, the roll gap between the guiding rollers is enlarged.

* * * * *